US011384965B2

(12) United States Patent
Ito et al.

(10) Patent No.: US 11,384,965 B2
(45) Date of Patent: Jul. 12, 2022

(54) REFRIGERATION CYCLE APPARATUS PERFORMING A REFRIGERANT CIRCULATION OPERATION USING A LIQUID PUMP

(71) Applicant: Mitsubishi Electric Corporation, Tokyo (JP)

(72) Inventors: Masahiro Ito, Tokyo (JP); So Nomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 95 days.

(21) Appl. No.: 16/489,536

(22) PCT Filed: Apr. 4, 2017

(86) PCT No.: PCT/JP2017/014107
§ 371 (c)(1),
(2) Date: Aug. 28, 2019

(87) PCT Pub. No.: WO2018/185841
PCT Pub. Date: Oct. 11, 2018

(65) Prior Publication Data

US 2020/0116396 A1 Apr. 16, 2020

(51) Int. Cl.
*F25B 13/00* (2006.01)
*F25B 7/00* (2006.01)
(Continued)

(52) U.S. Cl.
CPC ..... *F25B 13/00* (2013.01); *F25B 7/00* (2013.01); *F25B 41/20* (2021.01); *F25B 41/39* (2021.01);
(Continued)

(58) Field of Classification Search
CPC ..... F25B 2400/0401; F25B 2500/31
See application file for complete search history.

(56) References Cited

U.S. PATENT DOCUMENTS 3,960,322 A * 6/1976 Ruff ..... F03G 6/00 62/228.1
4,466,253 A * 8/1984 Jaster ..... F22B 3/045 60/686
(Continued)

FOREIGN PATENT DOCUMENTS

CA 2 298 373 A1 8/2001
JP H07-035422 A 2/1995
(Continued)

OTHER PUBLICATIONS

Office Action dated Jun. 2, 2020 for the corresponding JP application No. 2019-510537 (and English translation).
(Continued)

*Primary Examiner* — Jonathan Bradford
(74) *Attorney, Agent, or Firm* — Posz Law Group, PLC

(57) ABSTRACT

During a first cooling operation, a compressor is in an operational state, a liquid pump is in a non-operational state, and an amount of refrigerant allowing for existence of a liquid surface of the refrigerant in a refrigerant tank is accumulated in the refrigerant tank. During a second cooling operation, the compressor is in the non-operational state, the liquid pump is in the operational state, and the amount of the refrigerant allowing for the liquid surface of the refrigerant in the refrigerant tank is accumulated in the refrigerant tank.

13 Claims, 4 Drawing Sheets

(51) Int. Cl.
*F25B 41/20* (2021.01)
*F25B 41/39* (2021.01)

(52) U.S. Cl.
CPC ... *F25B 2400/0401* (2013.01); *F25B 2400/13* (2013.01); *F25B 2500/31* (2013.01); *F25B 2600/0251* (2013.01); *F25B 2700/2104* (2013.01); *F25B 2700/2106* (2013.01); *F25D 2700/14* (2013.01)

(56) References Cited

U.S. PATENT DOCUMENTS

| | | | | |
|---|---|---|---|---|
| 5,842,352 | A * | 12/1998 | Gregory | F25B 47/022 62/206 |
| 2003/0136140 | A1* | 7/2003 | Maeda | F25B 5/04 62/271 |
| 2003/0159455 | A1 | 8/2003 | Aikawa et al. | |
| 2007/0209380 | A1* | 9/2007 | Mueller | F25B 47/025 62/260 |

FOREIGN PATENT DOCUMENTS

| | | | |
|---|---|---|---|
| JP | H10-185342 | A | 7/1998 |
| JP | 2001-263835 | A | 9/2001 |
| JP | 2002-061918 | A | 2/2002 |
| JP | 2002-106986 | A | 4/2002 |
| JP | 2003-285633 | A | 10/2003 |
| JP | 2007-255862 | A | 10/2007 |
| JP | 2014-126291 | A | 7/2014 |
| JP | 2016-041987 | A | 3/2016 |

OTHER PUBLICATIONS

Office Action dated Aug. 18, 2020 for the corresponding JP application No. 2019-510537 (and English translation).
Extended European Search Report dated Jan. 28, 2020 for the corresponding EP application No. 17904890.5.
International Search Report of the International Searching Authority dated Jun. 27, 2017 for the corresponding international application No. PCT/JP2017/014107 (and English translation).

* cited by examiner

FIG.1

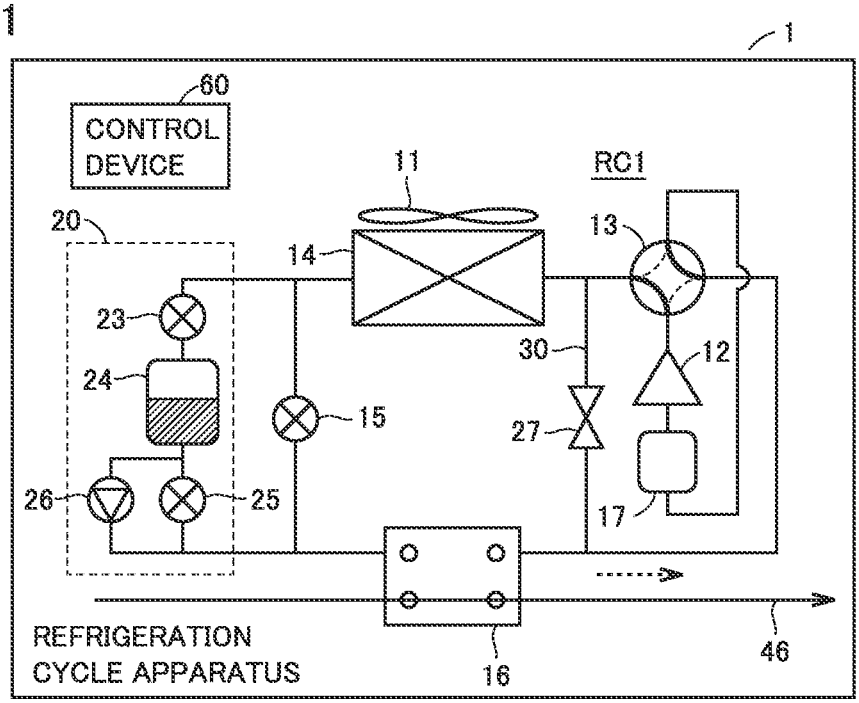

FIG.2

| | FIRST COOLING OPERATION (T ≥ T1) | SECOND COOLING OPERATION (T < T1) | HEATING OPERATION |
|---|---|---|---|
| COMPRESSOR | ON | OFF | ON |
| LIQUID PUMP | OFF | ON | OFF |
| FLOW PATH SWITCHING DEVICE | FIRST STATE | | SECOND STATE |
| FIRST THROTTLE DEVICE | OPENED | FULLY CLOSED | OPENED |
| SECOND THROTTLE DEVICE | OPENED | FULLY OPENED | FULLY CLOSED |
| THIRD THROTTLE DEVICE | OPENED | FULLY CLOSED | FULLY CLOSED |
| BYPASS VALVE | FULLY CLOSED | OPENED | FULLY CLOSED |
| BLOWER | ON | ON | ON |

REFRIGERATION CYCLE APPARATUS PERFORMING A REFRIGERANT CIRCULATION OPERATION USING A LIQUID PUMP

CROSS REFERENCE TO RELATED APPLICATION

This application is a U.S. national stage application of International Application PCT/JP2017/014107 filed on Apr. 4, 2017, the contents of which are incorporated herein by reference.

TECHNICAL FIELD

The present invention relates to a refrigeration cycle apparatus.

BACKGROUND

When a cooling operation is performed under such a condition that the temperature of outside air is low, it has been known that cooling performance is deteriorated if the operation is performed using a compressor. To address this, a refrigeration cycle apparatus has been known which can reduce an amount of consumed power by performing a refrigerant circulation operation using a liquid pump while utilizing coldness of outside air when the temperature of the outside air is low (for example, see Patent Literature 1).

PATENT LITERATURE

PTL 1: Japanese Patent Laying-Open No. 10-185342

However, in the cooling operation using the liquid pump as described in Patent Literature 1, saturated liquid is caused at an inlet of an indoor heat exchanger, with the result that a required amount of refrigerant is increased as compared with a case where the compressor is used therefor. Hence, the required amount of refrigerant for the operation using the liquid pump should be sealed in the refrigeration cycle apparatus. However, when such an amount of refrigerant is sealed, an excess of refrigerant circulates during the operation using the compressor, with the result that cooling performance may be decreased.

Moreover, when the refrigerant is insufficient during the operation using the liquid pump, the refrigerant flowing out from an air heat exchanger becomes two-phase refrigerant. Hence, gas is included in the refrigerant flowing from a refrigerant tank to the liquid pump. As a result, the liquid pump runs on idle and the liquid refrigerant is not transported accordingly.

SUMMARY

In view of the above, an object of the present invention is to provide a refrigeration cycle apparatus that can avoid a liquid pump from running on idle during a cooling operation using the liquid pump and that can avoid an excess of refrigerant from circulating during a cooling operation using a compressor.

A refrigeration cycle apparatus of the present invention is a refrigeration cycle apparatus comprising a refrigerant circuit, wherein the refrigerant circuit comprises: a compressor configured to compress refrigerant; an air heat exchanger configured to exchange heat between air and the refrigerant; a first throttle device; a water heat exchanger configured to exchange heat between the refrigerant and water; and a refrigerant tank and a liquid pump each connected to the first throttle device in parallel. The refrigerant circuit further comprises: a bypass pipe connected to the compressor in parallel; and a bypass valve configured to adjust an amount of the refrigerant flowing in the bypass pipe. During a first cooling operation, the compressor is in an operational state, the liquid pump is in a non-operational state, and an amount of the refrigerant allowing for existence of a liquid surface of the refrigerant in the refrigerant tank is accumulated in the refrigerant tank. During a second cooling operation, the compressor is in the non-operational state, the liquid pump is in the operational state, and the amount of the refrigerant allowing for the existence of the liquid surface of the refrigerant in the refrigerant tank is accumulated in the refrigerant tank.

According to the present invention, cooling performance can be prevented from being decreased, because the excessive amount of refrigerant obtained by subtracting the amount of refrigerant required for the first cooling operation from the amount of refrigerant sealed in the refrigerant circuit is accumulated in the refrigerant tank during the first cooling operation. According to the present invention, the liquid pump can be prevented from running on idle, because the liquid surface of the refrigerant exists in the refrigerant tank during the second cooling operation.

BRIEF DESCRIPTION OF DRAWINGS

FIG. 1 shows a configuration of a refrigeration cycle apparatus of a first embodiment.

FIG. 2 shows states of components in the refrigeration cycle apparatus during a heating operation, a first cooling operation and a second cooling operation.

DETAILED DESCRIPTION

First Embodiment

Figure 3:
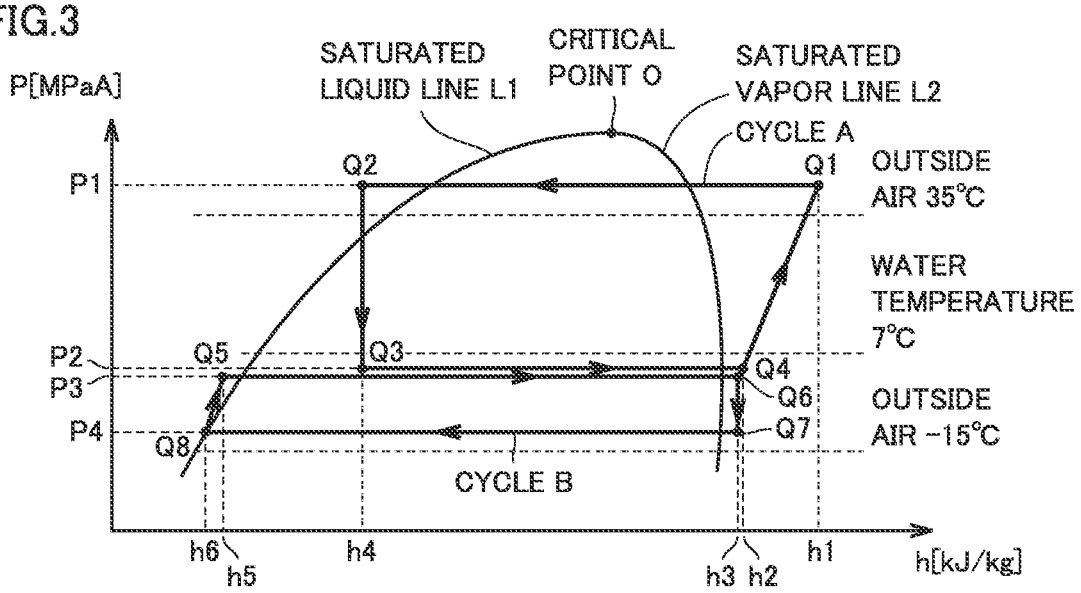
FIG. 3 is a P-h diagram during each of the first cooling operation and the second cooling operation.

FIG. 1 shows a configuration of a refrigeration cycle apparatus 1 of a first embodiment.

As shown in FIG. 1, refrigeration cycle apparatus 1 includes a refrigerant circuit RC1 and a control device 60.

Refrigerant circuit RC1 includes a compressor 12, a flow path switching device 13, an air heat exchanger 14, a first throttle device 15, a water heat exchanger 16, and an accumulator 17, which are sequentially connected to one another via pipes. Refrigerant circuit RC1 further includes a refrigerant tank circuit 20 connected to first throttle device 15 in parallel via a pipe.

Refrigerant circuit RC1 further includes: a bypass pipe 30 connected to compressor 12, flow path switching device 13, and accumulator 17 in parallel; and a bypass valve 27 configured to adjust an amount of the refrigerant flowing in the bypass pipe.

Refrigerant tank circuit 20 includes a refrigerant tank 24 and a liquid pump 26 connected in series, refrigerant tank 24 and liquid pump 26 being disposed in this order relative to air heat exchanger 14.

Refrigerant tank circuit 20 further includes: a second throttle device 23 disposed between air heat exchanger 14 and refrigerant tank 24; and a third throttle device 25 connected to liquid pump 26 in parallel.

In refrigerant circuit RC1, refrigerant involving a phase change, such as carbon dioxide and R410A, circulates.

Compressor 12 is configured to suction and compress low-pressure refrigerant and discharge the refrigerant as high-pressure refrigerant. Compressor 12 is an inverter compressor variable in a discharge capacity for the refrigerant, for example.

In a first state, flow path switching device 13 is configured to connect the discharge side of compressor 12 to air heat exchanger 14 and connect the suction side of compressor 12 to water heat exchanger 16 so as to form a first flow path in which the refrigerant discharged from compressor 12 flows to air heat exchanger 14. In a second state, flow path switching device 3 is configured to connect the discharge side of compressor 12 to water heat exchanger 16 and connect the suction side of compressor 12 to air heat exchanger 14 so as to form a second flow path in which the refrigerant discharged from compressor 12 flows to water heat exchanger 16.

Flow path switching device 13 switches between the first state and the second state in accordance with an instruction signal from control device 60. Flow path switching device 13 is a device that has a valve body provided at the pipe in which the refrigerant flows and that is configured to switch between the above-described refrigerant flow paths by switching this valve body between opened and closed states. Flow path switching device 3 is also referred to as a "four-way valve".

In air heat exchanger 14, heat is exchanged between the refrigerant flowing in the flow path and air external to the flow path. A blower 11 is provided near air heat exchanger 14. The heat exchange in air heat exchanger 14 is facilitated by air blown from blower 11. Blower 11 includes a fan and a motor configured to rotate the fan. Blower 11 is a blower variable in rotating speed, for example. An amount of heat absorption of the refrigerant in air heat exchanger 14 can be adjusted by adjusting the rotating speed of the motor.

First throttle device 15 can decompress the high-pressure refrigerant. Examples of first throttle device 15 usable herein include a device having a valve body capable of adjusting a degree of opening, such as an electronic control type expansion valve.

Water heat exchanger 16 is connected to not only refrigerant circuit RC1 but also a water circuit 46, and is configured to exchange heat between the refrigerant flowing in the flow path and water flowing in water circuit 46. The water flowing in water circuit 46 is heated or cooled by water heat exchanger 16. The water flowing in water circuit 46 is used for indoor air conditioning, for example.

Accumulator 17 is a container configured to store the refrigerant therein, and is installed at the suction side of compressor 12. Accumulator 17 has an upper portion connected to a pipe via which the refrigerant flows in and has a lower portion connected to a pipe via which the refrigerant flows out. Gas-liquid separation of the refrigerant is performed in accumulator 17. The gas refrigerant resulting from the gas-liquid separation is suctioned to compressor 12. By accumulator 17, the liquid refrigerant can be prevented from being supplied to compressor 12.

Bypass valve 27 is provided at the pipe that connects air heat exchanger 14 to water heat exchanger 16 in parallel with a path extending through accumulator 17, compressor 12, and flow path switching device 13.

Second throttle device 23 can decompress the high-pressure refrigerant. Examples of second throttle device 23 usable herein include a device having a valve body capable of adjusting a degree of opening, such as an electronic control type expansion valve. Alternatively, examples of second throttle device 23 usable herein include a device with a fixed degree of opening, such as a capillary tube.

Refrigerant tank 24 is a container configured to store the refrigerant therein. A flow inlet for the refrigerant in refrigerant tank 24 is connected to second throttle device 23 via a pipe. A flow outlet for the refrigerant in refrigerant tank 24 is connected to liquid pump 26 and third throttle device 25 via a pipe. In refrigerant tank 24, gas-liquid separation of the refrigerant can be performed. For example, the flow inlet for the refrigerant in refrigerant tank 24 is disposed at the uppermost position of refrigerant tank 24 in the vertical direction, whereas the flow outlet for the refrigerant in refrigerant tank 24 is disposed at the lowermost position of refrigerant tank 24 in the vertical direction.

Third throttle device 25 is connected to the flow outlet of refrigerant tank 24 via a pipe. Third throttle device 25 can decompress the high-pressure refrigerant. Examples of third throttle device 25 usable herein include a device having a valve body capable of adjusting a degree of opening, such as an electronic control type expansion valve.

Liquid pump 26 is connected to the flow outlet of refrigerant tank 24 via a pipe. Liquid pump 26 supplies the liquid refrigerant in refrigerant tank 24 to water heat exchanger 16. By liquid pump 26, the pressure of the liquid refrigerant is increased.

Control device 60 controls switching among the first cooling operation, the second cooling operation, and the heating operation.

In the cooling operation of refrigeration cycle apparatus 1, control device 60 performs control such that the first cooling operation is performed when a temperature T of outside air is more than or equal to a threshold value TH, and such that the second cooling operation is performed when temperature T of the outside air is less than threshold value TH. Temperature T of the outside air can be detected by a temperature sensor (not shown) disposed outdoor.

The first cooling operation is a vapor compression type refrigerant operation using compressor 12. The second cooling operation is a circulation type cooling operation using liquid pump 26.

When the temperature of the outside air is low, motive power for transporting the refrigerant in the cooling operation using liquid pump 26 is smaller than that in the cooling operation using compressor 12. Hence, an amount of consumed power becomes small.

Assume that W1 represents an amount of refrigerant required for refrigerant circuit RC1 in the first cooling operation, W2 represents an amount of refrigerant required for refrigerant circuit RC1 in the second cooling operation, and W3 represents an amount of refrigerant required for refrigerant circuit RC1 in the heating operation. In this case, the following relation is satisfied: $W2>W1>W3$. Here, the expression "amount of refrigerant required" refers to an amount of refrigerant that is required to circulate in refrigerant circuit RC1 in each operation.

Assume that $W2+\alpha$ represents an amount of refrigerant sealed in refrigerant circuit RC1. $\alpha$ represents an amount with which a liquid surface always exists in refrigerant tank 24 during the second cooling operation. In this way, during the second cooling operation, only the liquid refrigerant, rather than the gas refrigerant, can be supplied to liquid pump 26.

During the first cooling operation, an excessive amount (W2+α-W1) of refrigerant is accumulated in refrigerant tank 24, whereas during the heating, an excessive amount (W2+α-W3) of refrigerant is accumulated in refrigerant tank 24.

FIG. 2 shows states of the components in the refrigeration cycle apparatus during the heating operation, the first cooling operation and the second cooling operation.

FIG. 3 is a P-h diagram during each of the first cooling operation and the second cooling operation.

When the temperature of the outside air is 35° C. and the water temperature is 7° C., the first cooling operation is performed in a cycle A. When the temperature of the outside air is −15° C. and the water temperature is 7° C., the second cooling operation is performed in a cycle B.

(Heating Operation)

Figure 4:
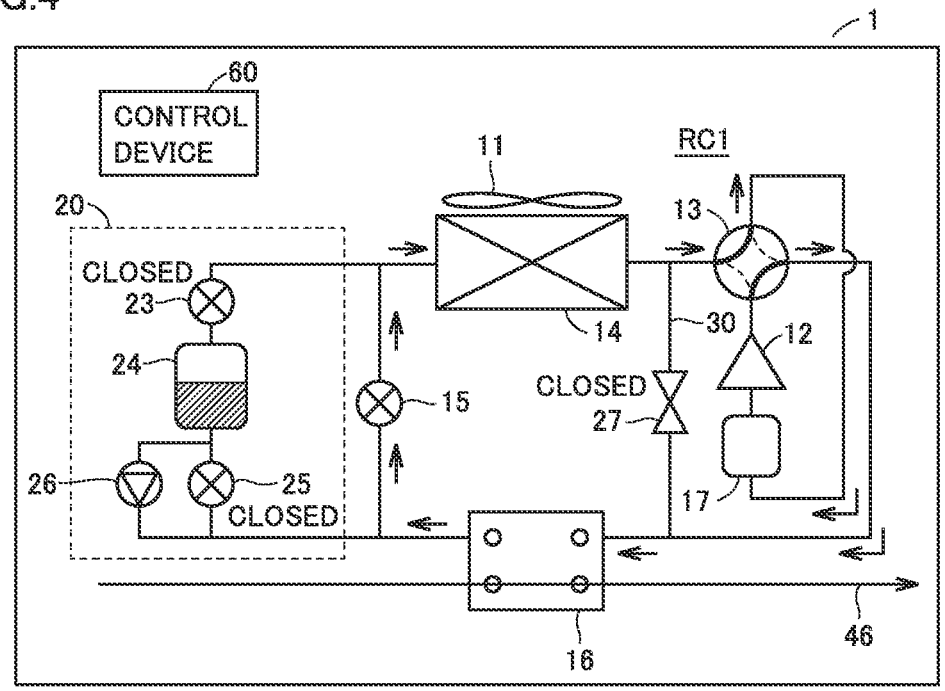
FIG. 4 shows a flow of refrigerant during the heating operation.

FIG. 4 shows a flow of the refrigerant during the heating operation.

With reference to FIG. 2 and FIG. 4, the following describes a flow of the refrigerant in the heating operation.

During the heating operation, compressor 12 is in the operational state (ON), liquid pump 26 is in the non-operational state (OFF), flow path switching device 13 is in the second state, first throttle device 15 is in the opened state, second throttle device 23 is in the fully closed state, third throttle device 25 is in the fully closed state, bypass valve 27 is in the fully closed state, and blower 11 is in the operational state (ON).

Since flow path switching device 13 is in the second state in the heating operation, the discharge side of compressor 12 is connected to water heat exchanger 16 to form the second flow path in which the refrigerant discharged from compressor 12 flows into water heat exchanger 16. The refrigerant circulates in order of water heat exchanger 16, first throttle device 15, air heat exchanger 14, and compressor 12. Air heat exchanger 14 serves as an evaporator and water heat exchanger 16 serves as a condenser.

The high-temperature high-pressure refrigerant discharged from compressor 12 flows into water heat exchanger 16 via flow path switching device 13. In water heat exchanger 16, the high-temperature high-pressure refrigerant is decreased in temperature as a result of heat exchange with the water flowing in water circuit 46, and flows out from water heat exchanger 16. The refrigerant flowing out from water heat exchanger 16 is decompressed by first throttle device 15 to become low-temperature low-pressure refrigerant, and then flows into air heat exchanger 14.

In air heat exchanger 14, the low-temperature low-pressure refrigerant is increased in temperature as a result of heat exchange with air blown from blower 11, and flows out from air heat exchanger 14. The refrigerant flowing out from air heat exchanger 14 flows into accumulator 17 via flow path switching device 13, and is subjected to gas-liquid separation in accumulator 17. The gas refrigerant in accumulator 17 is suctioned to compressor 12.

In the heating operation, the water flowing in water circuit 46 is heated by the refrigerant flowing in water heat exchanger 16. This heated water is used for indoor heating, for example. During the heating, an excessive amount (W2+α-W3) of refrigerant is accumulated in refrigerant tank 24. The accumulation of the refrigerant in refrigerant tank 24 can be performed by controlling second throttle device 23 and third throttle device 25 just before starting the heating. Accordingly, the excess of refrigerant can be avoided from circulating in refrigerant circuit RC1.

(First Cooling Operation)

Figure 5:
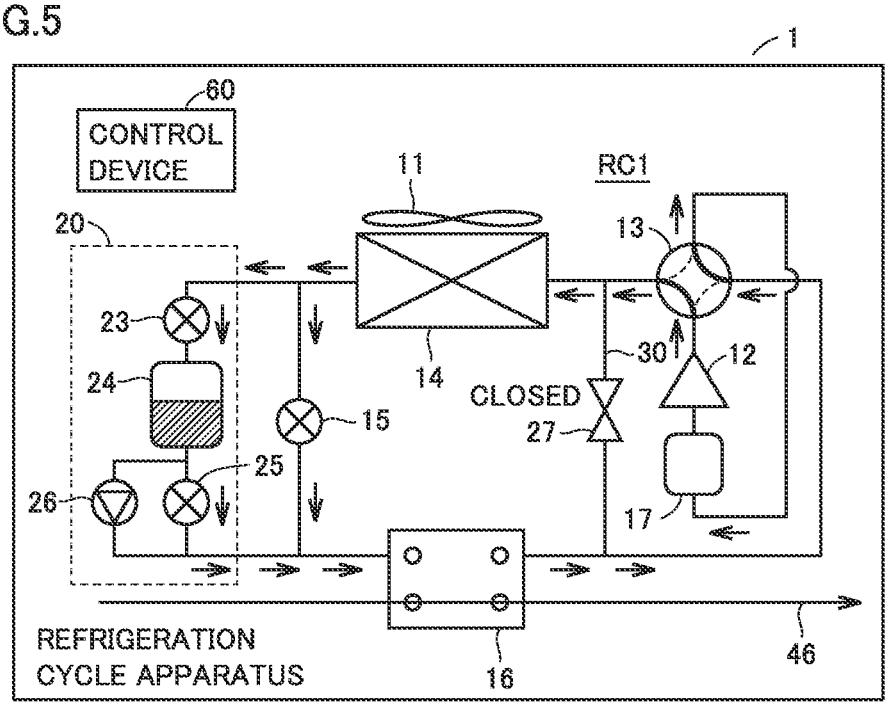
FIG. 5 shows a flow of the refrigerant during the first cooling operation.

FIG. 5 shows a flow of the refrigerant during the first cooling operation.

With reference to FIG. 2, FIG. 3, and FIG. 5, the following describes the flow of the refrigerant during the first cooling operation.

During the first cooling operation, compressor 12 is in the operational state (ON), liquid pump 26 is in the non-operational state (OFF), flow path switching device 13 is in the first state, first throttle device 15 is in the opened state, second throttle device 23 is in the opened state, and third throttle device 25 is in the opened state, bypass valve 27 is in the fully closed state, and blower 11 is in the operational state (ON).

Since flow path switching device 13 is in the first state in the first cooling operation, the discharge side of compressor 12 is connected to air heat exchanger 14 to form the first flow path in which the refrigerant discharged from compressor 12 flows into air heat exchanger 14. The refrigerant circulates in order of air heat exchanger 14, first throttle device 15, water heat exchanger 16, and compressor 12. Air heat exchanger 14 serves as a condenser and water heat exchanger 16 serves as an evaporator.

The high-temperature high-pressure refrigerant discharged from compressor 12 flows into air heat exchanger 14 via flow path switching device 13 (Q1 in the P-h diagram of FIG. 3). In air heat exchanger 14, the high-temperature high-pressure refrigerant is condensed as a result of heat exchange with air blown from blower 11, and flows out from air heat exchanger 14 (Q2 in the P-h diagram of FIG. 3). The refrigerant flowing out from air heat exchanger 14 is decompressed by first throttle device 15 to become low-temperature low-pressure refrigerant, and then flows into water heat exchanger 16 (Q3 in the P-h diagram of FIG. 3).

In water heat exchanger 16, the low-temperature low-pressure refrigerant is evaporated as a result of heat exchange with the water flowing in water circuit 46, and flows out from water heat exchanger 16 (Q4 in the P-h diagram of FIG. 3). The refrigerant flowing out from water heat exchanger 16 flows into accumulator 17 via flow path switching device 13, and is subjected to gas-liquid separation in accumulator 17. The gas refrigerant in accumulator 17 is suctioned to compressor 12. Compressor 12 is configured to suction and compress low-pressure refrigerant and discharge the refrigerant as high-pressure refrigerant.

Control device 60 detects a degree of superheating of the refrigerant flowing out from water heat exchanger 16, and adjusts a degree of opening of first throttle device 15 such that the degree of superheating becomes a target value set in advance (superheating degree control). By increasing the degree of opening of first throttle device 15, the degree of superheating of the refrigerant flowing out from water heat exchanger 16 can be decreased. By decreasing the degree of opening of first throttle device 15, the degree of superheating of the refrigerant flowing out from water heat exchanger 16 can be increased.

Control device 60 controls second throttle device 23 and third throttle device 25 such that the amount of the refrigerant circulating in refrigerant circuit RC1 becomes a predetermined amount during the first cooling operation. For example, when starting the first cooling operation, control device 60 fully opens second throttle device 23 and fully closes third throttle device 25 until an amount (WX=(W2+α-W1)) of refrigerant obtained by subtracting, from the amount (W2+α) of sealed refrigerant, amount W1 of refrigerant required to circulate in refrigerant circuit RC1 in the first cooling operation is accumulated in refrigerant tank 24. When amount WX of refrigerant is accumulated in refrigerant tank 24, control device 60 fully closes second throttle device 23.

Alternatively, during the first cooling operation, instead of the refrigerant flowing into and then remaining in refrigerant tank 24, the refrigerant may flow into refrigerant tank 24 and then may flow out from refrigerant tank 24 with amount WX of refrigerant remaining in refrigerant tank 24. In this case, the pressure and enthalpy of the refrigerant flowing out from refrigerant tank circuit 20 are the same as the pressure and enthalpy of the refrigerant flowing out from first throttle device 15. Therefore, the change from Q2 to Q3 in the P-h diagram of FIG. 3 represents not only changes in pressure and enthalpy of the refrigerant flowing via first throttle device 15 but also changes in pressure and enthalpy of the refrigerant flowing via refrigerant tank circuit 20.

Figure 6:
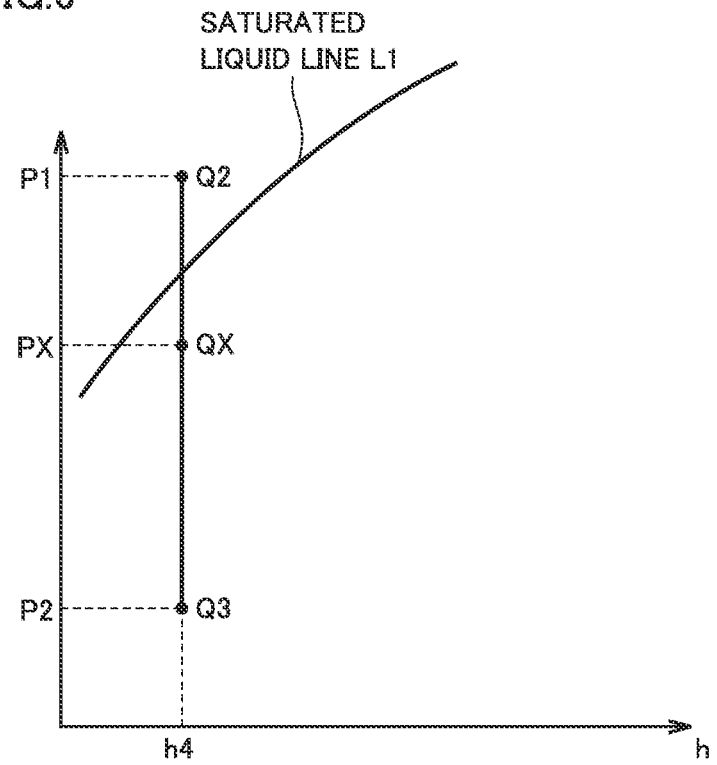
FIG. 6 shows a change in P-h of the refrigerant flowing in a refrigerant tank circuit 20 during the first cooling operation.

FIG. 6 shows a change in P-h of the refrigerant flowing in refrigerant tank circuit 20 during the first cooling operation.

Q2, which represents the pressure and enthalpy of the refrigerant flowing into second throttle device 23, corresponds to Q2 in FIG. 3.

By throttling the refrigerant by second throttle device 23, the two-phase refrigerant flows into refrigerant tank 24 (QX in FIG. 6). The liquid refrigerant is accumulated in the lower portion of refrigerant tank 24. The liquid refrigerant in the lower portion of refrigerant tank 24 is exhausted by third throttle device 25.

Control device 60 adjusts the degree of opening of second throttle device 23 and the degree of opening of third throttle device 25 so as to accumulate amount WX of refrigerant in refrigerant tank 24. In this way, although the refrigerant flows into refrigerant tank 24 and flows out from refrigerant tank 24, amount WX of refrigerant is always accumulated in refrigerant tank 24. Also in this way, the degree of subcooling of the refrigerant flowing out from air heat exchanger 14 is decreased.

It should be noted that in addition to or instead of control device 60 controlling second throttle device 23 and third throttle device 25 to accumulate amount WX of refrigerant in refrigerant tank 24, control device 60 may control second throttle device 23 and third throttle device 25 in the following manner.

Control device 60 may be configured to detect the degree of subcooling of the refrigerant flowing out from air heat exchanger 14, and also adjust the degree of opening of third throttle device 25 such that the degree of subcooling becomes a target value set in advance (subcooling control). By increasing the degree of opening of third throttle device 25, the degree of subcooling of the refrigerant flowing out from air heat exchanger 14 can be increased. By decreasing the degree of opening of third throttle device 25, the degree of subcooling of the refrigerant flowing out from air heat exchanger 14 can be decreased.

Further, control device 60 may be configured to adjust the degree of opening of second throttle device 23 such that a pressure difference (differential pressure) between the pressure at the inflow side of second throttle device 23 and the pressure of refrigerant tank 24 becomes a predetermined amount (differential pressure control). As the degree of opening of second throttle device 23 is more decreased, the differential pressure can be more increased.

Alternatively, control device 60 may be configured to set the degree of opening of second throttle device 23 to a fixed degree of opening. When the fixed degree of opening is employed, a capillary tube may be used as second throttle device 23, instead of the electronic control type expansion valve.

In the first cooling operation, the water flowing in water circuit 46 is cooled by the refrigerant flowing in water heat exchanger 16. The cooled water is used for indoor cooling, for example.

(Second Cooling Operation)

Figure 7:
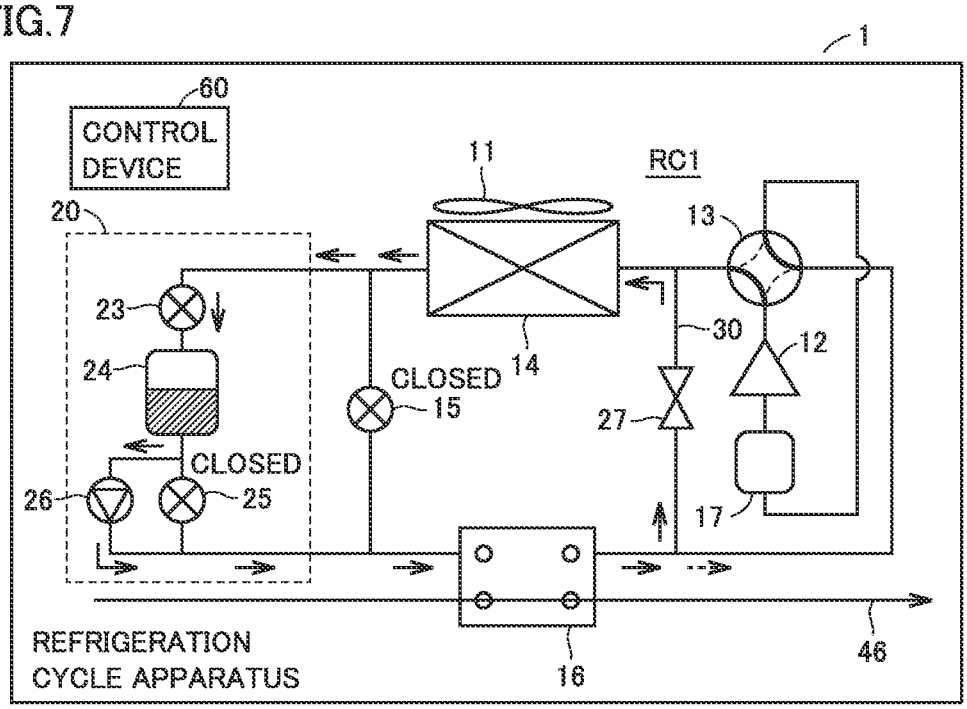
FIG. 7 shows a flow of the refrigerant during the second cooling operation.

FIG. 7 shows a flow of the refrigerant during the second cooling operation.

With reference to FIG. 2, FIG. 3, and FIG. 7, the following describes the flow of the refrigerant during the second cooling operation.

During the second cooling operation, compressor 12 is in the non-operational state (OFF), liquid pump 26 is in the operational state (ON), flow path switching device 13 is in the first state, first throttle device 15 is in the fully closed state, second throttle device 23 is in the fully opened state, and third throttle device 25 is in the fully closed state, bypass valve 27 is in the opened state, and blower 11 is in the operational state (ON).

Since compressor 12 is non-operational although flow path switching device 13 is in the first state in the second cooling operation, compressor 12 does not discharge the refrigerant.

The refrigerant circulates in order of liquid pump 26, water heat exchanger 16, bypass valve 27, and air heat exchanger 14. As with the first cooling operation, air heat exchanger 14 serves as a condenser and water heat exchanger 16 serves as an evaporator.

The liquid refrigerant discharged from liquid pump 26 flows into water heat exchanger 16 (Q5 in the P-h diagram of FIG. 3).

The liquid refrigerant is evaporated as a result of heat exchange with the water flowing in water circuit 46 in water heat exchanger 16, and flows out from water heat exchanger 16 (Q6 in the P-h diagram of FIG. 3).

The high-temperature high-pressure refrigerant having flown out from water heat exchanger 16 is decompressed in bypass valve 27, and flows into air heat exchanger 14 (Q7 in the P-h diagram of FIG. 3).

In air heat exchanger 14, the high-temperature high-pressure refrigerant is condensed as a result of heat exchange with air blown from blower 11, and flows out from air heat exchanger 14 (Q8 in the P-h diagram of FIG. 3).

Since second throttle device 23 is fully opened, the refrigerant having flown out from air heat exchanger 14 flows into refrigerant tank 24 with the pressure and enthalpy thereof being substantially unchanged.

The liquid refrigerant in refrigerant tank 24 is suctioned into liquid pump 26, and the liquid refrigerant increased in pressure is discharged and flows into water heat exchanger 16 (Q5 in the P-h diagram of FIG. 3).

Here, amount a of liquid refrigerant is always accumulated in refrigerant tank 24. Therefore, the liquid surface always exists in refrigerant tank 24. Accordingly, during the second cooling operation, only the liquid refrigerant, rather than the gas refrigerant, can be supplied to liquid pump 26.

During the second cooling operation, as with the first cooling operation, the water flowing in water circuit 46 is cooled by the refrigerant flowing in water heat exchanger 16. The cooled water is used for indoor cooling, for example.

It should be noted that control device 60 may control the degree of opening of bypass valve 27 such that the degree of subcooling of the refrigerant flowing out from air heat exchanger 14 becomes more than or equal to 0. By decreasing the degree of opening of bypass valve 27, the degree of subcooling is increased. By increasing the degree of opening of bypass valve 27, the degree of subcooling is decreased. In this case, an electronic control type expansion valve may be used for bypass valve 27. By using the electronic control type expansion valve, the degree of subcooling is adjusted to facilitate attaining a liquid state at the inlet of liquid pump 26.

According to the present embodiment, since the excess of refrigerant is accumulated in the refrigerant tank during the first cooling operation as described above, performance during the first cooling operation can be suppressed from being decreased. Moreover, since the liquid surface always exists in refrigerant tank 24 during the second cooling operation, the liquid pump can be avoided from running on idle.

Second Embodiment

Figure 8:
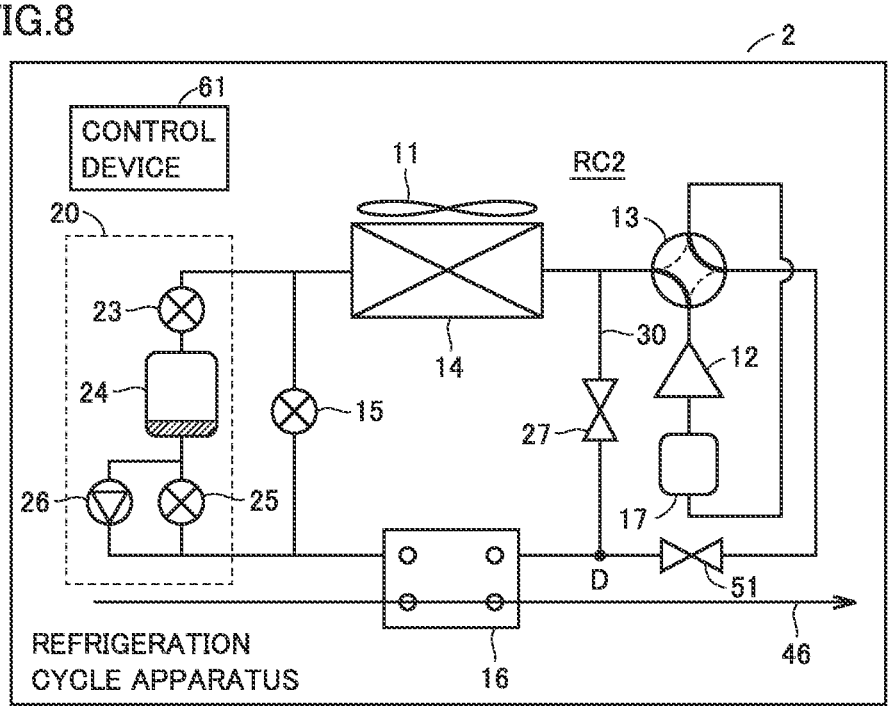
FIG. 8 shows a configuration of a refrigeration cycle apparatus of a second embodiment.

FIG. 8 shows a configuration of a refrigeration cycle apparatus of a second embodiment.

A refrigeration cycle apparatus 2 of FIG. 8 is different from refrigeration cycle apparatus 1 of FIG. 1 in that a refrigerant circuit RC2 of refrigeration cycle apparatus 2 of FIG. 8 includes a valve 51.

In the first embodiment, when the refrigerant flows into compressor 12 during the second cooling operation, the refrigerant is cooled by compressor 12 and the refrigerant may be accumulated in compressor 12. As a result, the amount of refrigerant to circulate becomes insufficient, with the result that gas refrigerant may be suctioned to liquid pump 26. In the present embodiment, such a problem can be avoided by valve 51.

Valve 51 is disposed between compressor 12 and a branch point D of a path from water heat exchanger 16 to compressor 12 and a path from water heat exchanger 16 to bypass value 27.

Control device 61 fully opens valve 51 in the heating operation and the first cooling operation, and fully closes valve 51 in the second cooling operation. Accordingly, the refrigerant can be avoided from flowing into compressor 12 during the second cooling operation.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

The invention claimed is:

1. A refrigeration cycle apparatus comprising a refrigerant circuit, wherein the refrigerant circuit comprises a compressor configured to compress refrigerant, an air heat exchanger configured to exchange heat between air and the refrigerant, a first throttle device, a water heat exchanger configured to exchange heat between the refrigerant and water, a refrigerant tank and a liquid pump each connected to the first throttle device in parallel, a bypass pipe connected to the compressor in parallel, a bypass valve configured to adjust an amount of the refrigerant flowing in the bypass pipe, a second throttle device disposed between the air heat exchanger and the refrigerant tank, a third throttle device connected to the liquid pump in parallel, and a controller configured to operate the refrigeration cycle apparatus as follows:

during a first cooling operation, the compressor is in an operational state, the liquid pump is in a non-operational state, and an amount of the refrigerant allowing for existence of a liquid surface of the refrigerant in the refrigerant tank is accumulated in the refrigerant tank, and during a second cooling operation, the compressor is in the non-operational state, the liquid pump is in the operational state, and the amount of the refrigerant allowing for the existence of the liquid surface of the refrigerant in the refrigerant tank is accumulated in the refrigerant tank, during the first cooling operation, an excess amount of the refrigerant is accumulated in the refrigerant tank by way of respective degrees of opening of the second throttle device and the third throttle device, the excess amount of the refrigerant being obtained by subtracting an amount of the refrigerant required for the first cooling operation from an amount of the refrigerant sealed in the refrigerant circuit, during the second cooling operation, an excess amount of the refrigerant is accumulated in the refrigerant tank by way of respective degrees of opening of the second throttle device and the third throttle device, the excess amount of the refrigerant being obtained by subtracting an amount of the refrigerant required for the second cooling operation from the amount of the refrigerant sealed in the refrigerant circuit, wherein the amount of the refrigerant required for the second cooling operation is larger than the amount of the refrigerant required for the first cooling operation.

2. The refrigeration cycle apparatus according to claim 1, wherein the first cooling operation is performed when a temperature of outside air is more than or equal to a threshold value, and the second cooling operation is performed when the temperature of the outside air is less than the threshold value.

3. The refrigeration cycle apparatus according to claim 1, wherein during the first cooling operation, an amount of the refrigerant circulating in the refrigerant circuit is adjusted to a determined amount by way of respective degrees of opening of the second throttle device and the third throttle device.

4. The refrigeration cycle apparatus according to claim 1, wherein the second throttle device is set to a fixed degree of opening during the first cooling operation.

5. The refrigeration cycle apparatus according to claim 1, wherein during the first cooling operation, a difference between a pressure of the refrigerant flowing into the second throttle device and a pressure of the refrigerant in the refrigerant tank is controlled to be a predetermined value by the second throttle device.

6. The refrigeration cycle apparatus according to claim 1, wherein during the first cooling operation, a degree of subcooling of the refrigerant flowing out from the air heat exchanger is controlled by way of a degree of opening of the third throttle device.

7. The refrigeration cycle apparatus according to claim 1, wherein the second throttle device is in a fully opened state during the second cooling operation, and the third throttle device is in a fully closed state during the second cooling operation.

8. The refrigeration cycle apparatus according to claim 1, wherein the bypass valve is constituted of an electronic control type expansion valve.

9. The refrigeration cycle apparatus according to claim 8, wherein a degree of subcooling of the refrigerant flowing out from the air heat exchanger is controlled by way of a degree of opening of the bypass valve.

10. The refrigeration cycle apparatus according to claim 1, wherein the refrigerant circuit comprises a valve disposed between the compressor and a branch point of a path from the water heat exchanger to the compressor and a path from the water heat exchanger to the bypass value, wherein the valve is in a fully closed state during the second cooling operation, and the valve is in a fully opened state during the first cooling operation.

11. The refrigeration cycle apparatus according to claim 1, wherein the compressor is operational during the first cooling operation, and is non-operational during the second cooling operation.

12. The refrigeration cycle apparatus according to claim 1, wherein the liquid pump is non-operational during the first cooling operation, and is operational during the second cooling operation.

13. The refrigeration cycle apparatus according to claim 1, wherein the refrigerant circuit comprises a four-way valve connected to an input and an output of the compressor, wherein during a heating operation, the four-way valve is in a first state, the first throttle device is in an opened state, and the bypass valve is in a fully closed state to circulate the refrigerant in order of the compressor, the four-way valve, the water heat exchanger, the first throttle device, the air heat exchanger, and the four-way valve, and during the heating operation, an excess amount of the refrigerant is accumulated in the refrigerant tank, the excess amount of the refrigerant being obtained by subtracting an amount of the refrigerant required for the heating operation from an amount of the refrigerant sealed in the refrigerant circuit.

* * * * *